US007823340B2

(12) United States Patent
DeJonge et al.

(10) Patent No.: US 7,823,340 B2
(45) Date of Patent: Nov. 2, 2010

(54) AIR GRATE FOR RAISED FLOORS

(75) Inventors: Mark O. DeJonge, Ada, MI (US); James F. Clifford, Byron Center, MI (US)

(73) Assignee: Opstock, Inc., Ada, MI (US)

( * ) Notice: Subject to any disclaimer, the term of this patent is extended or adjusted under 35 U.S.C. 154(b) by 801 days.

(21) Appl. No.: 11/744,341

(22) Filed: May 4, 2007

(65) Prior Publication Data

US 2008/0274685 A1 Nov. 6, 2008

(51) Int. Cl.
*E04B 5/48* (2006.01)

(52) U.S. Cl. ..... 52/126.2; 52/126.5; 52/302.1

(58) Field of Classification Search ..... 52/126.2, 52/220.1, 263, 302.1, 126.5, 661, 673
See application file for complete search history.

(56) References Cited

U.S. PATENT DOCUMENTS

| | | | | |
|---|---|---|---|---|
| 2,792,985 | A * | 5/1957 | Heiman | 415/148 |
| 3,153,553 | A * | 10/1964 | Bela | 292/336.3 |
| 3,236,018 | A | 2/1966 | Graham et al. | |
| 3,255,687 | A * | 6/1966 | Glaser | 454/298 |
| 3,511,011 | A | 5/1970 | Morgan, Jr. | |
| 4,258,516 | A | 3/1981 | Mori et al. | |
| 4,268,077 | A * | 5/1981 | Bohleen et al. | 292/336.3 |
| 4,319,520 | A * | 3/1982 | Lanting et al. | 454/290 |
| 4,348,841 | A | 9/1982 | Ueno et al. | |
| 4,399,741 | A * | 8/1983 | Zboralski | 454/59 |
| 4,558,544 | A | 12/1985 | Albrecht et al. | |
| 4,593,499 | A * | 6/1986 | Kobayashi et al. | 52/126.6 |
| 4,606,156 | A | 8/1986 | Sweers et al. | |
| 4,676,036 | A | 6/1987 | Bessert | |
| 4,719,727 | A | 1/1988 | Cooper et al. | |
| 4,736,555 | A | 4/1988 | Nagare et al. | |
| 4,745,715 | A | 5/1988 | Hardwicke et al. | |
| 4,825,603 | A | 5/1989 | Hardwicke et al. | |
| 4,856,256 | A | 8/1989 | Tokuzo | |
| D306,350 | S | 2/1990 | Hardwicke et al. | |
| 4,901,490 | A | 2/1990 | Zinniel et al. | |

(Continued)

OTHER PUBLICATIONS www.triad-usfloors.com, Pages from website of Triad Access Floors Company.

(Continued)

*Primary Examiner*—David Dunn
*Assistant Examiner*—Adam Barlow
(74) *Attorney, Agent, or Firm*—Price, Heneveld, Cooper, DeWitt & Litton, LLP

(57) ABSTRACT

An air grate for a raised floor includes a top plate with apertures for air flow, and reinforcement ribs for structural support. Pairs of ribs include edge flanges that define a horizontal track. Two flat dampener panels temporarily flex to slip between the edge flanges for assembly and then unflex for adjustable movement along the track between different overlapping positions for controlled air flow. The top plate includes corner-forming sections and leveling legs for height adjustment. Foot-print-expanding brackets engage the leveling legs for extending their foot print outwardly so that the air grate can be used on different raised floor systems without misalignment problems with stanchion supports. A handle is pivotally mounted in the top plate between a flush position and a raised position for grasping to lift the air grate, the handle having apertures matching the pattern of the top plate.

15 Claims, 6 Drawing Sheets

U.S. PATENT DOCUMENTS

| | | | | |
|---|---|---|---|---|
| 4,914,881 | A | | 4/1990 | Spork |
| 4,924,760 | A | * | 5/1990 | Jobson ..... 454/358 |
| 4,996,804 | A | | 3/1991 | Naka et al. |
| 5,052,156 | A | | 10/1991 | Tanaka et al. |
| 5,072,557 | A | | 12/1991 | Naka et al. |
| D350,613 | S | | 9/1994 | Fahy, Jr. |
| 5,386,670 | A | | 2/1995 | Takeda et al. |
| 5,389,737 | A | | 2/1995 | Kobayashi et al. |
| 5,402,617 | A | | 4/1995 | Daw et al. |
| 5,459,968 | A | | 10/1995 | Jin |
| 5,628,157 | A | | 5/1997 | Chen |
| 5,713,168 | A | | 2/1998 | Schilham |
| 6,101,768 | A | | 8/2000 | Springstead et al. |
| 6,256,952 | B1 | | 7/2001 | Fahy, Jr. et al. |
| 6,370,831 | B1 | | 4/2002 | Marshall et al. |
| 6,519,902 | B1 | | 2/2003 | Scissom |
| 6,550,195 | B1 | | 4/2003 | Cooper et al. |
| 6,637,161 | B1 | | 10/2003 | Buchalter et al. |
| 6,748,707 | B1 | | 6/2004 | Buchalter et al. |
| 6,840,555 | B1 | | 1/2005 | Thompson |
| 6,918,217 | B2 | | 7/2005 | Jakob-Bamberg et al. |
| 6,983,570 | B2 | | 1/2006 | Mead |
| 7,052,053 | B2 | * | 5/2006 | Hall et al. ..... 292/126 |
| 7,360,343 | B1 | * | 4/2008 | Spransy et al. ..... 52/263 |
| 2002/0144477 | A1 | | 10/2002 | Chen |
| 2005/0050818 | A1 | | 3/2005 | Chen et al. |
| 2005/0193660 | A1 | | 9/2005 | Mead |
| 2005/0235589 | A1 | | 10/2005 | Jakob-Bamberg et al. |
| 2006/0248814 | A1 | | 11/2006 | Chen et al. |

OTHER PUBLICATIONS

ASM Modular Floors Catalog, Innovations in Access Flooring.
InterfaceAR, Product Profile: TEcCrete Access Flooring.
cTec Access Flooring Systems, cTec, Inc.
Computer Environments, Inc., Brochure.
PATI, Raised Access Floor System Brochure.
Aspmaxcess, Global Leaders in Intelligent Office Solutions, Raised Floor Guide.
Architectural Solutions, Pathways Floors & Wiring—Steelcase.
InterfaceAR, Product Profile: TecSteel Access Flooring.
InterfaceAR: Atlantic Access Floors.
Access Floors Product Guide: Access Floors to the Power of Tate.

* cited by examiner

AIR GRATE FOR RAISED FLOORS

BACKGROUND

The present invention relates to an air grate for a raised floor system such as for a computer room, the air grate being configured for adjustable dampened air flow.

Raised floor systems allow flexible installation and distribution of cabling and wires, and also allow air conditioning to be funneled under the floor and into the room through apertured panels (also called "air grates") at selected strategic locations in the room. However, improvements are desired in these floor systems to allow adjustable control of air flow through the raised floor systems without substantial increase in manufacturing cost. Further, improvement is desired so that a particular apertured panel can be used to mate with a wide variety of existing raised floor panel systems. Still further, improvement is desired to provide an air grate with flush handle, where the apertured panel and handle are sufficiently sturdy to support substantial weight, yet where the handle is not a trip hazard and is sturdy enough to allow the panel to be lifted and removed without special tooling. It is also desirable to provide a handle that blends into the design of the air grate, and that does not result in an unsightly "blemish" in an otherwise visually attractive floor.

Air grates have considerable material cut away in order to allow significant air flow, yet air grates must maintain adequate weight-bearing strength to meet customer requirements. This problem is not easily solved, because air grates must rest on the same floor support as the raised floor panels. In other words, the problem usually cannot be resolved simply by making the reinforcement ribs of an air grate deeper, because the deeper reinforcement ribs would interferingly engage the floor support, resulting in an uneven floor surface. Further, the problem is not resolved simply by adding a large number of reinforcement ribs, since every rib adds expense, weight, and can adversely affect air flow. Additional of a handle further aggravates the problem, because the air grate must include an open space for receiving the handle, which further reduces the weight-bearing strength of the air grate.

Thus, an apparatus and method having the aforementioned advantages and solving the aforementioned problems are desired.

SUMMARY OF THE PRESENT INVENTION

In one aspect of the present invention, an air grate for a raised floor system is provided that includes a top plate with apertures for air flow through the top plate and for forming a part of a raised floor system, and a plurality of spaced-apart reinforcement ribs extending below the top plate for supporting weight on the top plate. At least two of the ribs extend in a parallel direction and include edge flanges that extend toward each other to define a horizontal track. A least one dampener panel is provided that is configured to temporarily flex to a bowed condition to slip between the edge flanges but also configured to unflex into a track-engaging condition for adjustable movement along the track between different dampening positions.

In another aspect of the present invention, an air grate for a raised floor system includes a top plate with apertures for air flow through the top plate and that is configured to form a part of a raised floor system. A plurality of spaced-apart reinforcement ribs extend below the top plate for supporting weight on the top plate, at least two of the ribs being parallel and including flanges that define a horizontal track. At least a pair of dampener panels are provided that are configured to adjustably move along the track between different overlapping dampening positions, the dampener panels being relatively flat and characteristically not having a pattern of apertures therein for air flow through the dampening panels.

In another aspect of the present invention, an air grate for a raised floor system includes a top plate with apertures for air flow through the top plate and for forming a part of a raised floor system and a plurality of spaced-apart reinforcement ribs extending below the top plate for supporting weight on the top plate and horizontal tracks defined under the top plate. A plurality of dampener panels are provided, each having a maximum size about equal to a quadrant of the top plate. The dampener panels are configured to slidably engage the tracks for movement between at least two of the quadrants of the top plate, with at least two of the dampener panels being movable between different overlapping dampening positions.

In yet another aspect of the present invention, a method of dampening air flow in a raised floor system comprises steps of providing a top plate with apertures for air flow through the top plate and for forming a part of a raised floor system, providing a plurality of spaced-apart reinforcement ribs extending below the top plate for supporting weight on the top plate, at least two of the ribs being parallel and including edge flanges that extend toward each other to define a horizontal track, and providing at least one dampener panel configured to temporarily flex. The method further includes bowing the dampener panel to a bowed condition to slip between the edge flanges and then unflexing the dampener panel into a track-engaging condition for adjustable movement along the track between different dampening positions.

In still another aspect of the present invention, a method of dampening in a raised floor system comprises steps of providing a top plate with apertures for air flow through the top plate and for forming a part of a raised floor system, providing a plurality of spaced-apart reinforcement ribs extending below the top plate for supporting weight on the top plate, at least two of the ribs being parallel and including flanges that define a horizontal track; and providing at least a pair of dampener panels that characteristically do not have a pattern of apertures therein for air flow through the dampening panels. The method includes moving the dampening panels along the track between different overlapping dampening positions to define different sized air flow openings.

In still another aspect of the present invention, an air grate for a raised floor system includes a top plate with apertures for air flow through the top plate and for forming a part of a raised floor system, and a plurality of spaced-apart reinforcement ribs extending below the top plate for supporting weight on the top plate, with at least two of the ribs being parallel. The top plate includes corner-forming sections that extend outboard from the outmost ones of the reinforcement ribs. Leveling legs (also called "leveling screws") operably engage the corner-forming sections for height adjustment. Foot-print-expanding brackets (also called "Z-brackets" herein) engage the leveling legs for extending the foot print of the leveling legs nearer to outer edges of the top plate so that the present air grate can be used on different raised floor systems without misalignment problems caused by different support stands.

In yet another aspect of the present invention, an air grate for a raised floor system includes a top plate with apertures for air flow through the top plate and for forming a part of a raised floor system. A plurality of spaced-apart reinforcement ribs extend below the top plate for supporting weight on the top plate, at least two of the ribs being parallel. The top plate includes marginal material defining an opening for a handle, and a handle is provided that is shaped to fit within the opening. The handle is pivotally supported for movement between a flush position where its upper surface aligns with an upper surface of the top plate, and a raised position where the handle can be grasped for lifting the air grate.

These and other aspects, objects, and features of the present invention will be understood and appreciated by those skilled in the art upon studying the following specification, claims, and appended drawings.

DETAILED DESCRIPTION OF PREFERRED EMBODIMENTS

Figure 1:
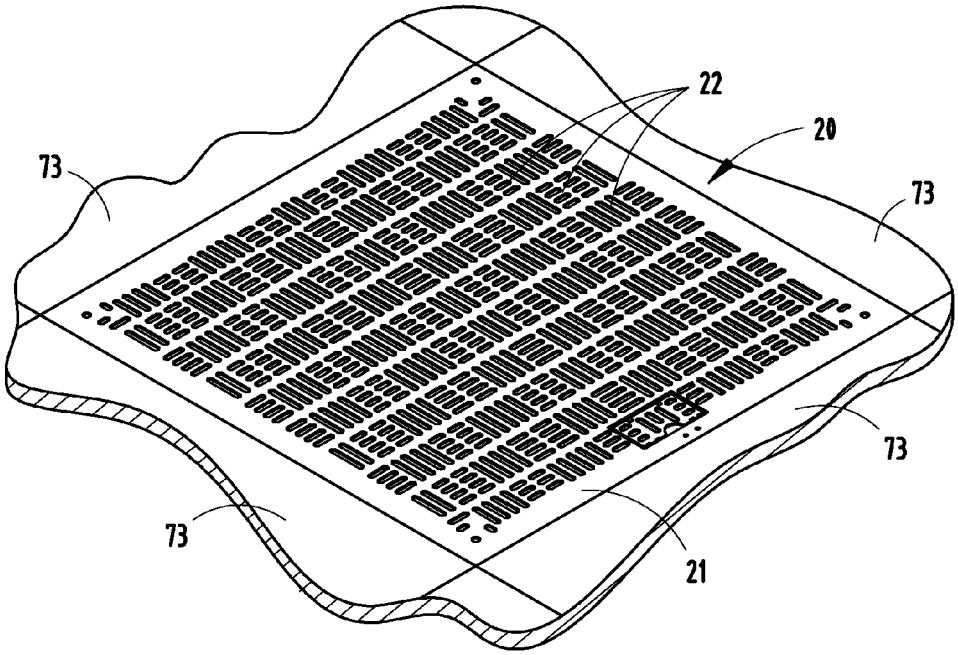
FIG. 1 is a perspective view of an air grate as part of a raised floor system.
Figure 2:
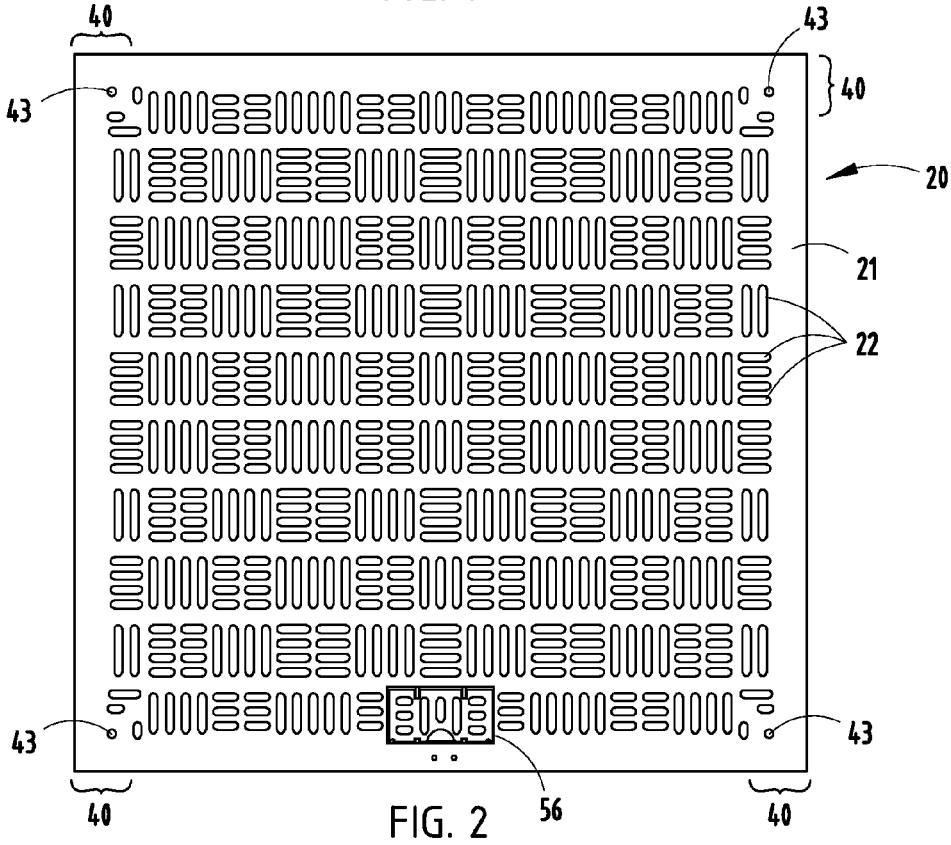
FIGS. 2-4 are top, bottom, and side views of the air grate of FIG. 1, FIG. 3 being a bottom view with dampener panels installed and FIG. 3A a similar view without dampener panels.
Figure 6:
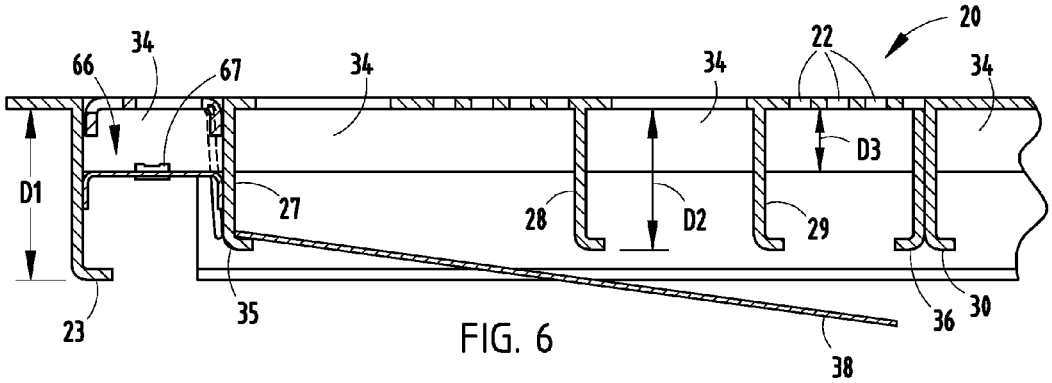
FIGS. 6-7 are side cross-sectional views showing installation of a dampener panel.

An air grate 20 (FIG. 1) is illustrated embodying the present invention. It is noted that specific dimensions are given to facilitate an understanding of the present invention, but that the present invention is not limited to only those dimension. The present air grate 20 is configured for use in a raised floor system as shown in FIG. 1, and includes a top plate 21 with apertures 22 for air flow, and includes a matrix of interconnected reinforcement ribs for structural support. Notably, the density of apertures 22 can be increased or decreased depending on the particular requirements of an installation. The illustrated apertures 22 provide up to about 50% open area for air flow. The illustrated ribs include perimeter ribs 23-26 (FIG. 6) of a first dimension D1 (approximately 2 inches high) welded to top plate 21, first parallel ribs 27-33 of a shorter second dimension D2 (about 1½ inches high) welded to top plate 21, and shorter second transverse parallel ribs 34 of a third dimension D3 (about ⅝ inch high) welded between the ribs 23, 25, 27-33 and to the top plate 21 for strength. The ribs 27 and 30 include L-shaped bottom edge flanges 35 and 36 that extend toward each other to define the bottom of a horizontal track for receiving a flat dampener panel 38. The bottom surfaces of the ribs 28 and 29 form a top of the horizontal track for sliding engagement with the dampener panel 38. The ribs 30 and 33 include edge flanges (similar to flanges 35 and 36) to define a second horizontal track for dampener panels (38).

The illustrated dampener panels 38 are flat sheet metal components shaped to temporarily flex to slip between the edge flanges for assembly. However, it is contemplated that the dampener panels 38 can be made of other materials, such as plastic and other non-metal materials. The sheet metal is resilient such that it springs back to an original flat shape (i.e., it "unflexes"), such that its edges engage the track for adjustable movement along the track between different overlapping positions. This allows for very low cost assembly, allows the use of low cost components, and allows for adjustable controlled air flow. The illustrated dampener panels 38 include a single short slot, allowing top adjustment using a tool such as a screwdriver without removing the air grate 20 from the floor.

Figure 11A:
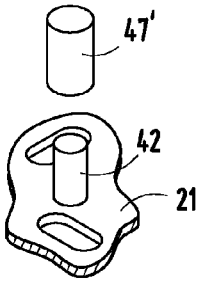
FIG. 11A is similar to FIG. 11 but illustrates an alternative design.
Figure 11:
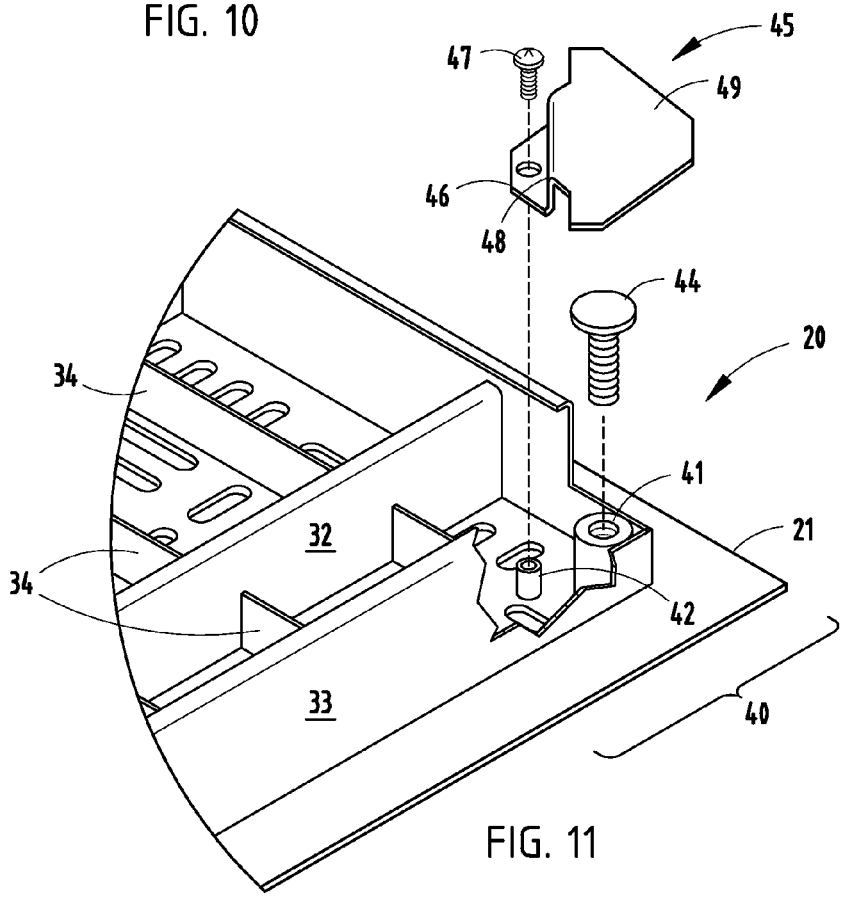
FIGS. 11-12 are a bottom exploded view and cross-sectional view of the corner arrangement of the present air grate including its leveling leg and Z-shaped corner bracket.
Figure 12:
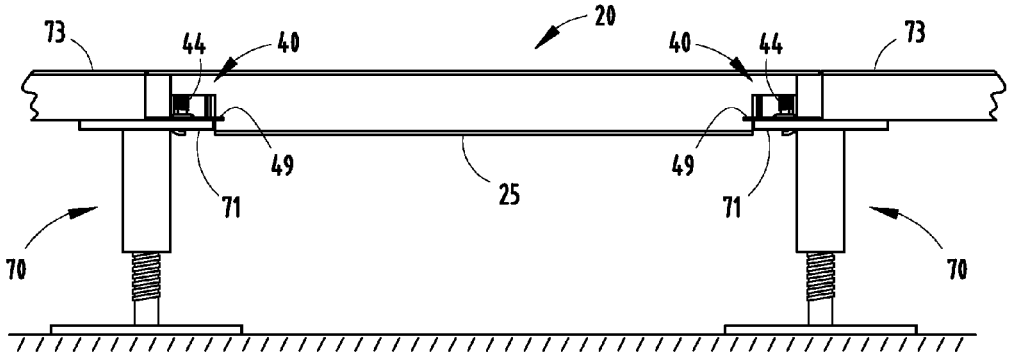
Figure 13:
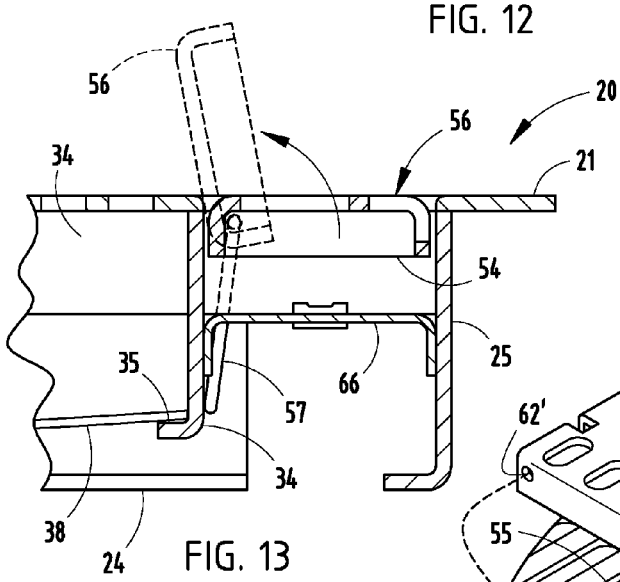
FIG. 13 is another cross-sectional view showing the present air grate and including its handle.

The top plate 21 of the air grate 20 includes corner-forming sections 40 (FIG. 11) that include first and second threaded bosses 41 and 42 attached to a bottom of each corner section 40. In the illustrated arrangement, the boss 41 is attached by welding, and the boss 42 is attached by a friction-fit. However, it is contemplated that other attachment ways could be used if desired. A hole 43 (FIG. 1) extends through the top plate 21 for top access to adjustable leveling legs 44 (also sometimes called "leveling screws") (FIG. 11). The legs 44 are threaded into the bosses 41, and include a downward foot that engages a top 71 of a vertically adjustable stand 70 (FIG. 12) for supporting the raised floor system. A foot-print-expanding stress-distributing corner bracket 45 (FIG. 11) is Z-shaped in side view, and includes a first flange 46 retained very loosely slipped onto the boss 42. A retainer screw 47 captures the flange 46 on the boss but allows the bracket 45 to slip vertically on the boss 42. The bracket 45 further includes a second perpendicular flange 48 extending from flange 46, and a third flange 49 extending from flange 48. The third flange 49 extends under the tip of the leveling leg 44 and extends to an outboard position that is approximately equal to the edge of the top plate 21. This extends the foot print of the leveling leg 44 outward to the edge of the air grate 20, allowing the air grate 20 to be used on different raised floor systems without misalignment problems with their respective stands 70 (FIG. 12) and the adjacent existing raised floor panels 73.

It is contemplated that the screw 47 can be replaced by various mechanisms to allow movement of the corner bracket 45 during adjustment of the leveling leg 44. For example, it is contemplated that the boss 42 can be elongated vertically, and that the screw 47 can be replaced with a sleeve 47' (FIG. 11A) that slips onto an end of the boss 42. In this arrangement, the sleeve frictionally engages an outer surface of the boss 42 to retain the corner bracket 45 on the boss 42. The sleeve 47' can be made of different materials, including for example metal, plastic, or rubber. Where the sleeve 47' has a relatively low friction on the boss 42, the sleeve 47' can be used to secure the corner bracket 45 tight against a bottom of the top plate 21, but will slide in a manner that allows the corner bracket 45 to slide downward on the boss 42 as the leveling leg 44 is extended during an installation. This allows the corner bracket 45 to be held securely to facilitate manufacture and shipping, but allows for an "automatic" adjustment of the sleeve 47' during installation.

Figure 14:
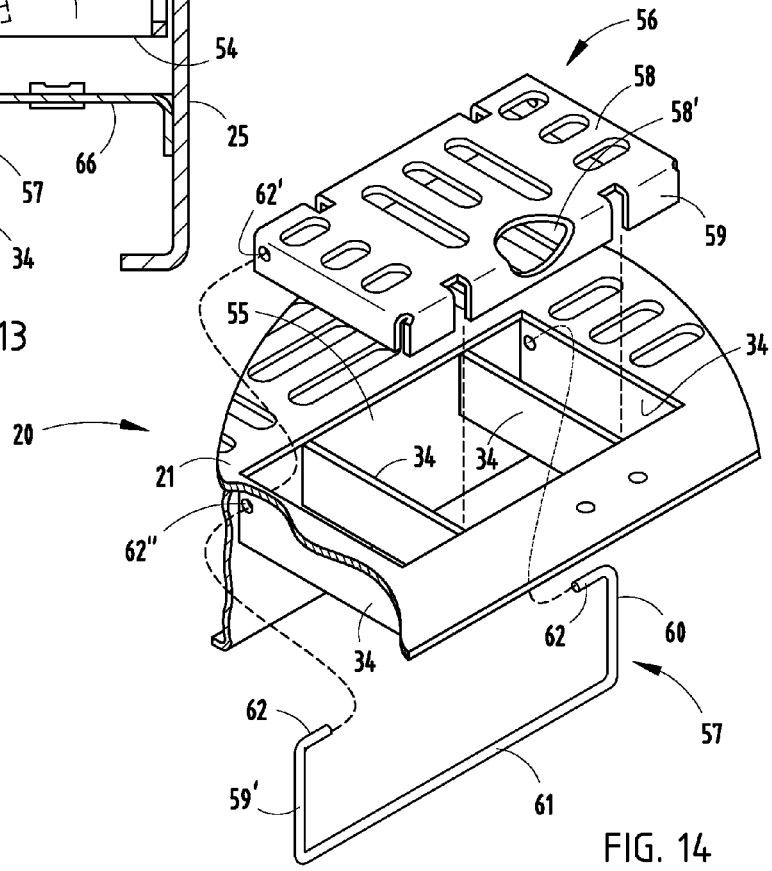
FIG. 14 is an enlarged cross-sectional view showing the handle and pivot member, the handle having its top surface apertured to match a pattern of the apertures in the air grate.

The top plate 21 (FIG. 14) includes a rectangular opening 55 in which a handle 56 is pivotally mounted by a spring wire member 57. The ribs 34 under the opening 55 define a pocket for the handle 56 to rest in when the handle 56 is in a closed flush-to-top-plate position. The handle 56 includes a top panel 58 that aligns with the top plate 21 when the handle 56 is closed. Edge flanges 59 extend from the top panel 58 and stiffen the top panel and also support the handle 56 on the ribs structure thereunder. The spring wire member 57 is generally U-shaped, and includes first and second legs 59-60 connected by a transverse section 61. A pivot-forming section 62 extends from each of the legs 59-60, with each being configured to fit through a hole 62' in the edge flanges 59' and into a mating hole 62" in the adjacent reinforcement rib 34 of the air grate 20. The spring wire member 57 is sufficiently resilient such that the legs 59-60 can be sprung apart for assembly, and when released, they move to the assembled position where they pivotally support the handle 56 in the opening 55. The pivot axis formed by the pivot-forming sections 62 is such that the handle 56 moves to an over-center position when in the raised position (such that the handle stays open and can easily be grasp in opening 58' for lifting the air grate 20 out of a floor system). However, the pivotal support is sufficiently low-friction, such that the handle 56 can be bumped and easily moved to its lowered, flush, closed position. Notably, the top panel 58 is apertured to match the pattern of apertures in the top plate 21 of the air grate 20. This provides an aesthetic match which thus avoids an unsightly blemish in the floor surface at the location of the handle. This is highly desirable to many customers, since a uniform and uninterrupted "clean" appearance of floors is important to many customers and users of raised floor systems.

Figure 3:
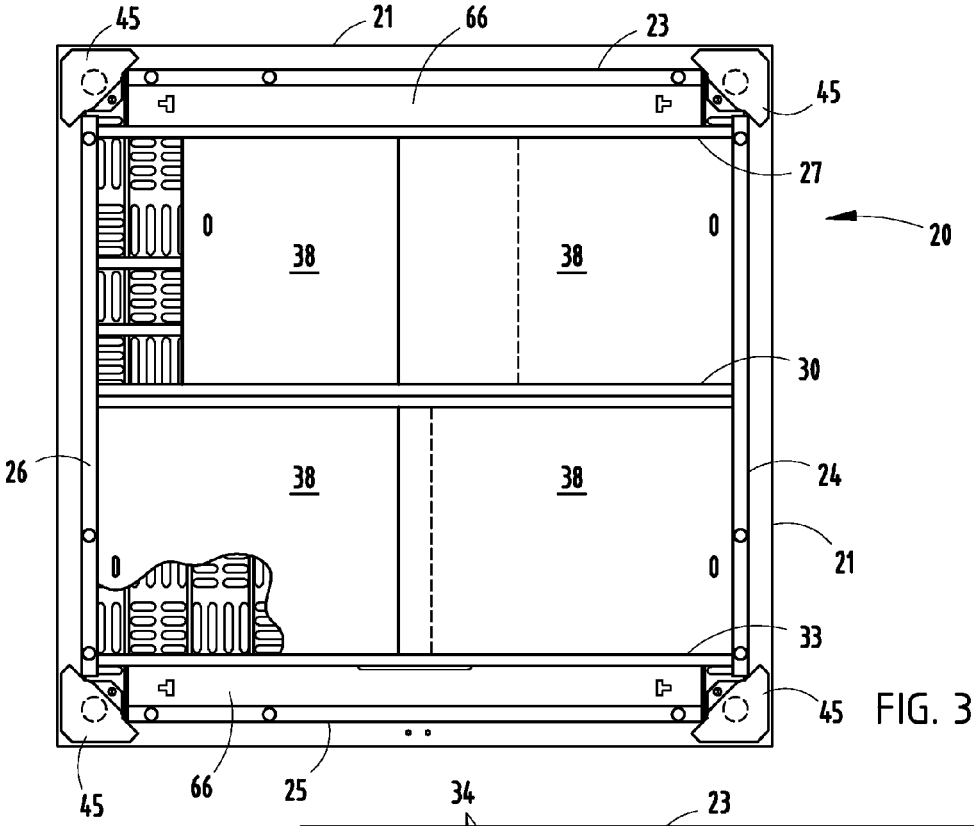
Figure 3A:
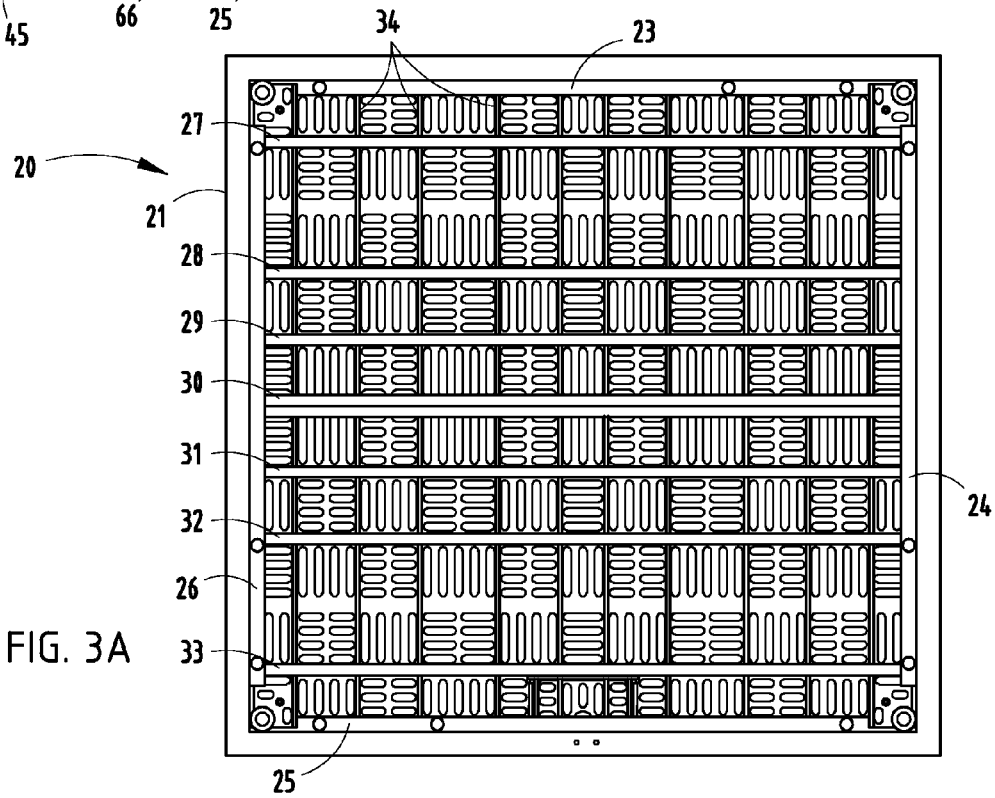
Figure 4:
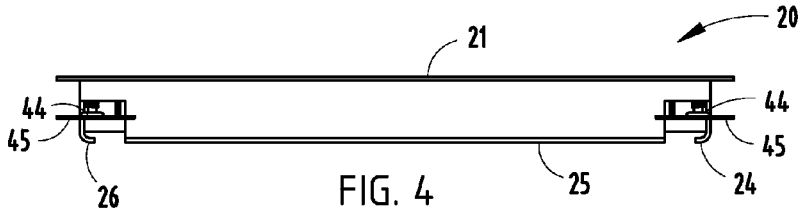
Figure 5:
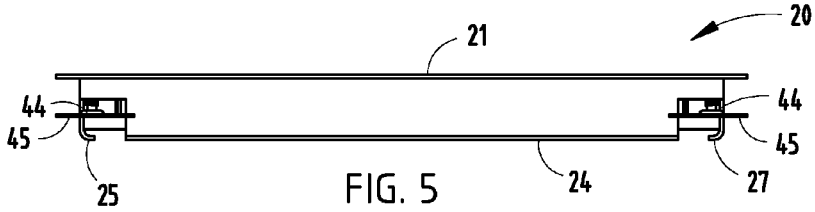
FIG. 5 is a side view of the air grate with dampener panels shown thereon.
Figure 7:
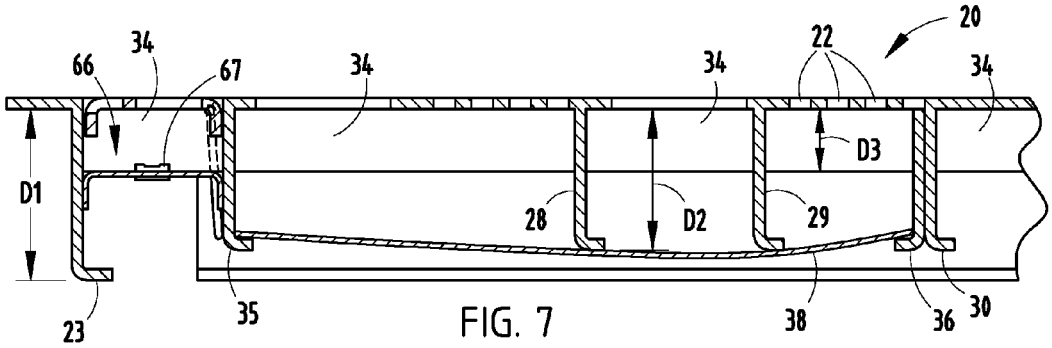
Figure 8:
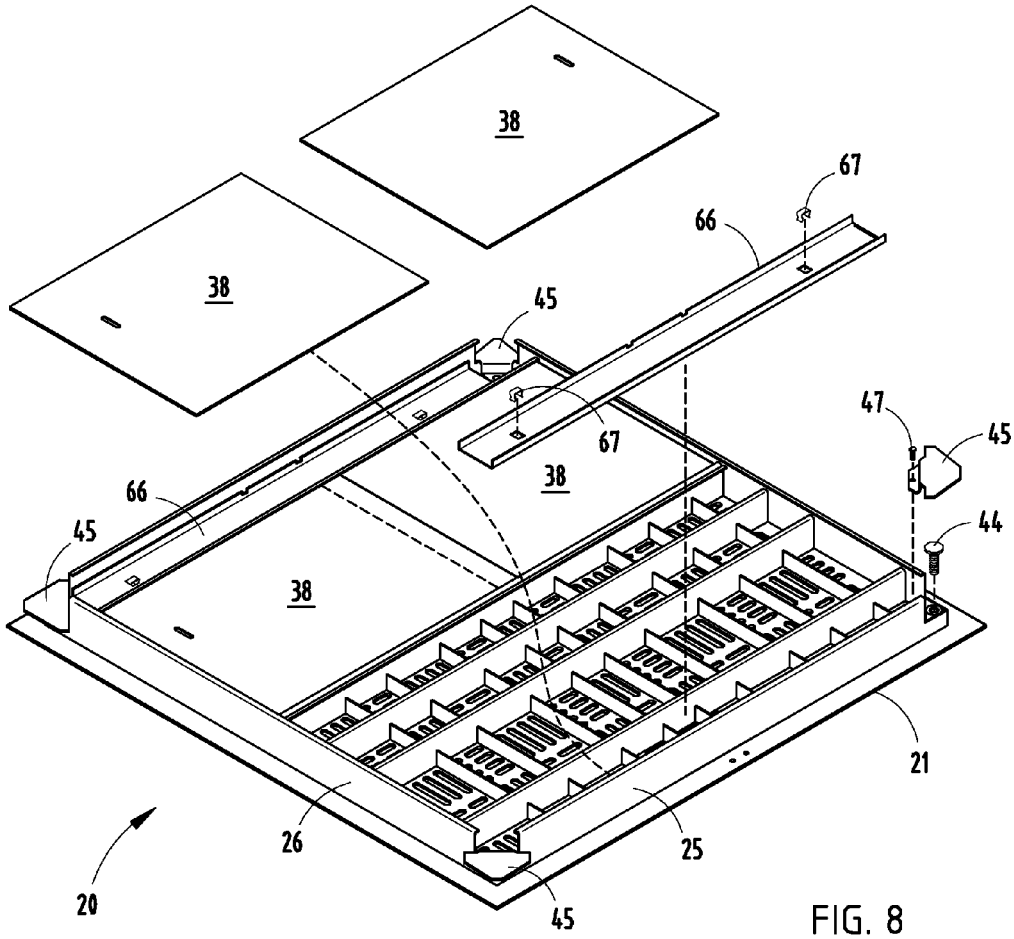
FIGS. 8-9 are perspective bottom and fragmentary bottom views of the air grate showing installation of the dampener skirt and showing the stress-distributing Z-shaped corner bracket.
Figure 9:
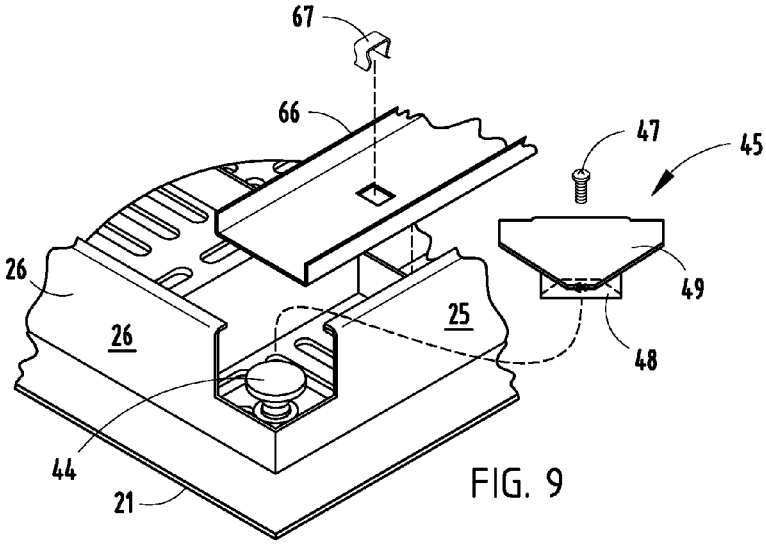
Figure 10:
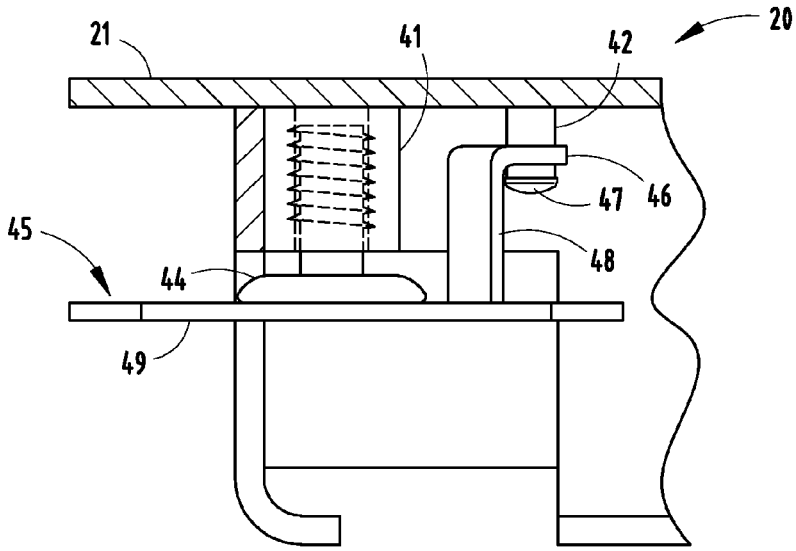
FIG. 10 is a cross-sectional view of the air grate including a showing of the leveling leg and the support-engaging stress-distributing Z-shaped corner bracket.

Dampener skirts 66 (FIGS. 6-7 and FIG. 3) are placed between the perimeter rib 23 and the adjacent reinforcement rib 27, and between the perimeter rib 25 and the adjacent reinforcement rib 33 to block undesired air flow if desired. The illustrated dampener skirts 66 are held in position by spring clips 67 that have a first portion that frictionally clips onto the dampener skirt 66 (such as onto the marginal material at a small hole in the skirt) and have a second portion with barbs that frictionally engage one of the ribs 34 under the skirt.

By the present construction, an air grate is provided that has exceptional weight-bearing strength, yet that can be mated flush to many existing raised floor systems without customization. Dampening can be adjusted easily on-site, and without separate tools, including elimination of one or more of the dampening panels. The leveling legs can be easily and quickly adjusted on-site. The air grate can be easily pulled up from the raised floor system due to the integral handle, yet the overall appearance remains very attractive since the handle does not produce an unsightly blemish in the overall floor appearance.

It is to be understood that variations and modifications can be made on the aforementioned structure without departing from the concepts of the present invention, and further it is to be understood that such concepts are intended to be covered by the following claims unless these claims by their language expressly state otherwise.

The invention claimed is:

1. An air grate for a raised floor system comprising:

a top plate with apertures for air flow through the top plate and for forming a part of a raised floor system;

a plurality of spaced-apart reinforcement ribs extending below the top plate for supporting weight on the top plate and defining first and second adjacent parallel coplanar horizontal tracks defined under the top plate; and a plurality of dampener panels each having a maximum size about equal to a quadrant of the top plate and not having a pattern of apertures therein, each of the dampener panels engaging one of the tracks for movement between at least two of the quadrants of the top plate, at least two of the dampener panels being movable between different overlapping dampening positions including a fully closed position, wherein the plurality of dampener panels include four dampener panels, one slidably to cover each quadrant.

2. The air grate of claim 1, including a skirt separate from the dampener panel and that extends along a side portion of a bottom of the top plate.

3. The air grate of claim 1, including an adjustable foot attached to a corner portion of the top plate.

4. The air grate of claim 3, including a stress-distributing bracket attached to the corner portion and that extends under a tip of the adjustable foot for distributing forces toward a corner of the top plate.

5. The air grate of claim 1, including a handle pivotally mounted to the panel and movable between a flush position that is level with the top plate and a raised position allowing the handle to be grasped for lifting the air grate.

6. The air grate of claim 5, including a spring clip with legs connected by a transverse member, the legs including pivot-forming sections and being resiliently supported for flexing movement between a first position allowing the pivot-forming sections to be positioned for assembly, and a second position where the pivot-forming sections engage the handle and holes in some of the ribs for pivotally supporting the handle.

7. The air grate of claim 1, wherein the dampener panels are flat panels.

8. An air grate configured and adapted for use with different raised floor systems having support stands with different floor-panel support surface configurations, but for use without misalignment problems with the respective support stands of the different raised floor systems, comprising:

a top plate with apertures for air flow through the top plate and adapted to form part of a selected one of the different raised floor systems;

a plurality of spaced-apart reinforcement ribs extending below the top plate for supporting weight on the top plate, at least two of the ribs being parallel;

the top plate and reinforcement ribs including corners; and corner-attached components at each of the corners including an adjustable leveling leg and bracket with horizontally-enlarged flange engaging the leveling leg, the corner-attached components being adapted and configured to support the air grate on any one of the different raised floor systems by adjustably extending a foot print of the leveling leg at each one of the corners beyond a size of an end of the leveling leg but without direct attachment of the corner-attached components to any of the differently-shaped floor-panel-supporting support stands, wherein the corner-attached components are attached to the air grate and carried therewith as an assembly to facilitate installation, and further wherein the corner-attached components do not include an aperture or fastener for attachment to any of the differently-shaped floor-panel-supporting support stands, but instead are configured to abut same.

9. The air grate defined in claim 8, wherein the enlarged flange extends to an outer edge of the air grate.

10. The air grate defined in claim 8, wherein the leveling legs engage one of the corners and an associated one of the brackets.

11. The air grate defined in claim 8, including dampener panels slidably mounted to tracks on the reinforcement ribs for adjustably controlling air flow through the air grate.

12. The air grate defined in claim 8, including a skirt separate from the dampener panel and that extends along a side portion of a bottom of the top plate.

13. The air grate defined in claim 8, including a handle operably mounted to the air grate and movable between a flush position that is level with the top plate and a raised position allowing the handle to be grasped for lifting the air grate.

14. The air grate defined in claim 8, wherein the handle is pivoted to the air grate.

15. The air grate defined in claim 14, including a spring clip with legs connected by a transverse member, the legs including pivot-forming sections and being resiliently supported for flexing movement between a first position allowing the pivot-forming sections to be positioned for assembly, and a second position where the pivot-forming sections engage the handle and holes in some of the ribs for pivotally supporting the handle.

* * * * *